US005686886A

United States Patent [19]

Stensney

[11] Patent Number: 5,686,886

[45] Date of Patent: Nov. 11, 1997

[54] ELECTRONIC NEIGHBORHOOD WATCH ALERT SYSTEM AND UNIT THEREFOR

[76] Inventor: John S. Stensney, 5334 Forrest Ct., Warrenton, Va. 22186

[21] Appl. No.: 266,896

[22] Filed: Jul. 1, 1994

[51] Int. Cl.[6] ..... G08B 1/08

[52] U.S. Cl. ..... 340/539; 340/506; 340/524; 340/825.36; 340/825.57; 340/825.69; 340/286.01

[58] Field of Search ..... 340/539, 531, 340/573, 506, 524, 525, 535, 825.36, 825.49, 286.02, 286.01, 293, 294, 815.48, 825.57, 825.69, 520, 569, 570

[56] References Cited

U.S. PATENT DOCUMENTS

| | | | |
|---|---|---|---|
| 3,478,344 | 11/1969 | Schwitzgebel et al. | 455/18 |
| 3,668,526 | 6/1972 | Raskin | 340/539 |
| 4,057,790 | 11/1977 | Fleming et al. | 340/539 |
| 4,673,920 | 6/1987 | Ferguson et al. | 340/506 |
| 4,772,876 | 9/1988 | Laud | 340/531 |
| 4,812,820 | 3/1989 | Chatwin | 340/518 |
| 4,871,997 | 10/1989 | Adriaenssens et al. | 340/531 |
| 4,994,787 | 2/1991 | Kratt et al. | 340/531 |
| 5,144,294 | 9/1992 | Alonzi et al. | 340/825.49 |
| 5,223,816 | 6/1993 | Levinson et al. | 340/531 |
| 5,319,355 | 6/1994 | Russek | 340/573 |
| 5,386,209 | 1/1995 | Thomas | 34/539 |
| 5,448,221 | 9/1995 | Weller | 340/539 |

*Primary Examiner*—Jeffery Hofsass
*Assistant Examiner*—Daryl C. Pope
*Attorney, Agent, or Firm*—Charlie T. Moon

[57] ABSTRACT

A neighborhood watch circuit alert system comprising a plurality of novel alert units that inform neighbors that are members of the watch circuit of another neighbor's emergency and their location so that the other neighbors can (1) notify the appropriate emergency department and (2) lend personal assistance until help arrives. Each alert unit includes a means for transmitting coded signals to other alert units in the watch circuit, an audible alarm, a plurality of address indicia means with associated separate visual indicator means for identifying and locating the transmitting unit, and means for receiving the coded signals from an alert unit in the watch circuit to sound the audible alarm and activate the visual indicator means to identify and locate the transmitting unit. The alert units may be developed to transmit and receive a plurality of different coded signals which would (1) utilize several different coded signals to selectively indicate different types of emergencies, and (2) use a different and distinct coded address signal to identify and locate the transmitting alert unit. Also a remote control may be provided with each alert unit that is code signal matched with its alert unit to enable the user to have freedom of movement within a limited distance of the alert unit but still have the capability of actuating same.

16 Claims, 7 Drawing Sheets

ELECTRONIC NEIGHBORHOOD WATCH ALERT SYSTEM AND UNIT THEREFOR

As never before our neighborhoods have concerns about fire, medical and criminal emergencies. These concerns while shared by all, have particular significance to the handicapped, senior citizens, latchkey children, and people who live alone in our communities. Normally fire, rescue and police squads will respond promptly when notified of an emergency. However, even when the neighbor with the emergency has opportunity to call the appropriate emergency department, there is an inherent and sometimes critical lapse of time before such squads arrive, depending upon distance, work loads, traffic, weather conditions, etc., which can permit the emergency to worsen resulting in a more serious property loss, personal danger, medical condition or even fatalities.

In the prior art, U.S. Pat. No. 4,057,790 to Fleming et al. discloses a personal-aid system for use by the infirm or elderly for summoning help of others who are located a distance away by using one or more portable radio-type transmitters, and a centralized monitor receiver with an alarm and alarm light associated therewith.

Each of U.S. Pat. Nos. 3,478,344 (Schwitzgebel et al.), 3,668,526 (Raskin) and 5,144,294 (Alonzi et al.) disclose systems using coded radio frequency signals to communicate emergency conditions to a monitor.

The present invention recognizes that the quickest response to an emergency in a neighborhood would be from nearby neighbors who could not only notify the appropriate emergency department but also possibly render personal assistance to the neighbor in need until the emergency squad arrives. It is noted that for the purpose of this invention, the term "neighborhood" encompasses residential, industrial plant, construction site, medical facility, shopping centers, businesses or any other environment that has common security or safety concerns that can be responded to by closely located fellow workers or neighbors.

Accordingly, it is an object of this invention to provide an emergency alert system comprising a plurality of alert units for use in a neighborhood watch circuit that would make monitors of the neighbors in the watch circuit so they become aware of another neighbor's emergency and address so that at least some of the other neighbors could notify the appropriate emergency department and also render personal assistance or intervention to the neighbor in need until such emergency squad arrives.

Another object of this invention is that each of the basic alert units includes a single emergency switch operated coded signal transmitter, a signal receiver associated with an audible alarm, a plurality of alert unit address indicia means, such as address labels, representing each of the alert units in the watch circuit and a visual indicator, such as a flashing light, associated with each alert unit address indicia means or address label. The audible alarm and transmitting unit address visual indicator on each of the units are actuated by coded signals received from a transmitting unit to thereby alert each member of the watch circuit of the emergency and address or location of the transmitting unit so that the other members can notify the appropriate emergency department and render personal assistance as required.

In the preferred form of the invention the alert unit is provided with at least three emergency switches having lights associated therewith to selectively identify different types of emergencies such as fire, medical, and criminal. Activation of a selected type emergency switch, i.e., fire, medical or criminal, on a given alert unit causes transmission of coded signals to the receiver of each of the units in the watch circuit to sound the audible alarm, activate the transmitting unit address visual indicator or light, and light the corresponding selected emergency switch to locate the transmitting unit and identify the type of emergency. It is noted that these functions are accomplished by using alert units in the watch circuit that are designed to transmit four different coded signals. Three of these different coded signals are fixed and selectable for indicating different types of emergencies, namely, (1) fire, (2) medical and (3) criminal, and are common to all the alert units in the watch circuit. However, the fourth coded signal transmitted is not only different but also distinct for each unit and when received by the other units in the watch circuit will actuate the transmitting unit address visual indicator or flashing light to locate same. The fourth coded signal is related with each of the other three different emergency type signals so that when a switch of a selected type emergency is activated on a transmitting unit the fourth different and distinct coded signal of that unit will be transmitted along with the selected type emergency coded signal. It is noted that the audible alarm that is associated with the receiver on all units will be activated when an appropriate transmitted coded signal is received.

Another object of the invention is to provide each alert unit in the watch circuit with a remote control that is code signal matched therewith. Such a remote control will permit anyone, and especially the vulnerable such as the handicapped, senior citizens and latchkey children, at an alert unit address to move about freely within a limited distance but still have the capability to activate an emergency switch on the code signal matched alert unit to transmit emergency and address visual indicator coded signals to the units in the watch circuit.

The coded signals utilized in the alert units of the neighborhood watch circuit of this invention are illustrated herein as radio wave signals, but the invention is not limited thereto since the coded signals can be produced in many forms such as by sonic signals, laser signals, microwave signals, and other signals that are well known in the signal transmission art. It should be borne in mind that in this invention the significance of the coded signals is not the form or source of the signals but rather that coded signals are utilized to actuate a function or functions on the alert units to make members of the watch circuit aware of the existence of an emergency and the location of same. The alert units of this invention could even be used with hard wired signal transmission systems, such as telephones, if desired.

While ten alert units are illustrated in the watch circuit herein, a smaller or larger number of units can be used as dictated by the neighborhood watch circuit membership so long as each unit is provided with the maximum number of address indicia means and visual indicator means required by the membership.

The use of the alert system of this invention additionally establishes a social interaction and involvement between the neighbors in the watch circuit and a spirit of community in caring for the well being of each other.

Other objects and advantages of this invention will become apparent from the description of the Figures of the drawing.

DETAILED DESCRIPTION OF DRAWING

Figure 1:
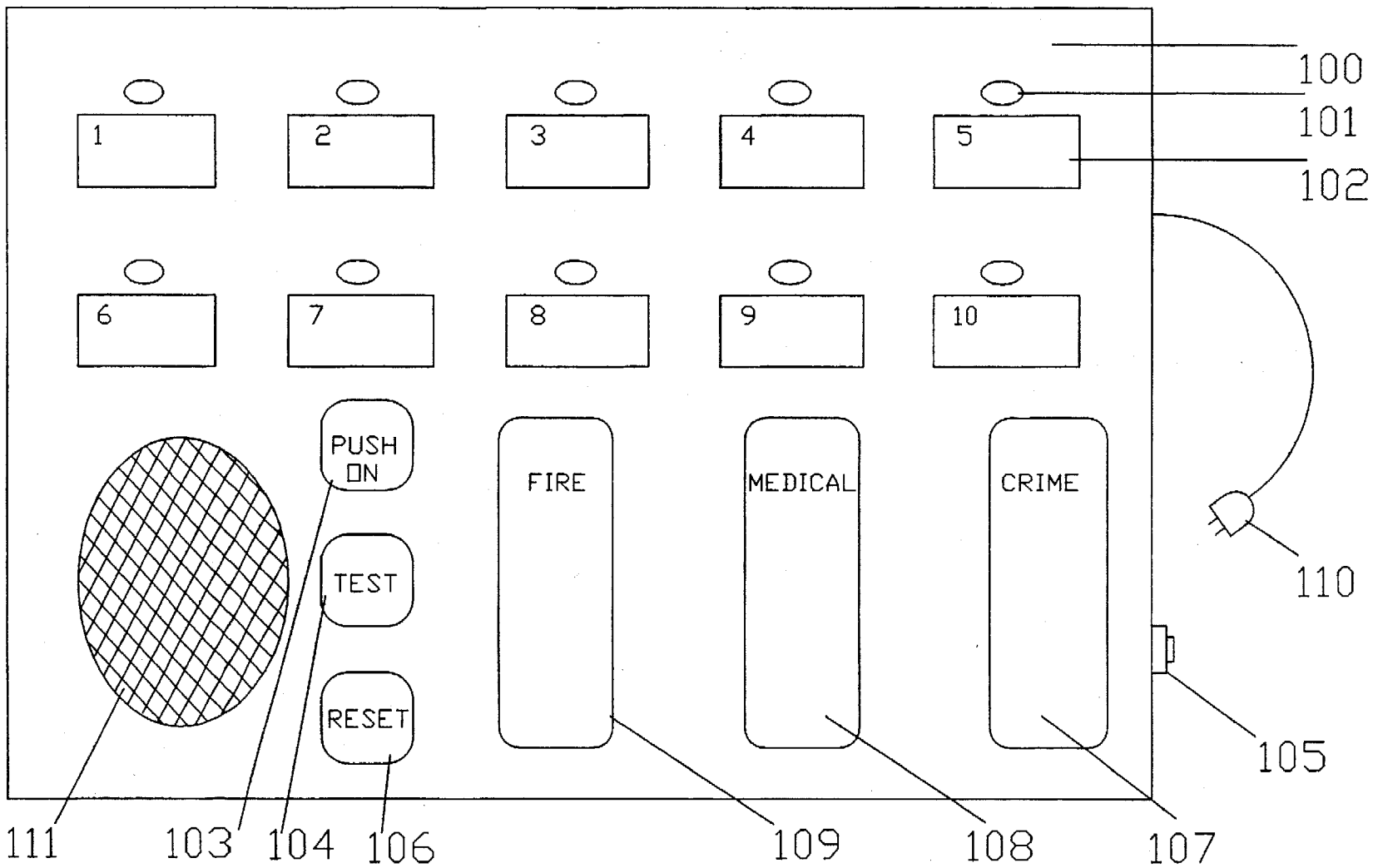
FIG. 1 is a top view of a preferred alert unit of the present invention.

The top of preferred alert unit 100 shown above in FIG. 1 includes visual indicators or light bulbs 101 adjacent each address indicia means or address labels 102 for each of the alert units numbered 1–10 in the watch circuit system. Push-on electrical switch 103 is for placing the alert unit in an operational mode and can be pushed to shut the alert unit off as well. Test switch button 104 is for the purpose of putting the alert unit through an internal dry run cycle to determine if the transmitter and receiver portions of the alert unit are performing properly without actually sending out an emergency signal to the other alert units in the watch circuit system. Numeral 105 illustrates a socket for receiving a cable plug of a police or private security monitoring system that can be used, if desired, as a backup to the neighborhood watch circuit system according to this invention. A reset switch button 106 is provided to cancel emergency signal transmissions that are accidentally initiated or have already been responded to. Numerals 107, 108 and 109 represent three switch buttons for different types of emergencies, i.e. criminal, medical and fire, respectively, and are associated with different colored flashing lights, i.e., crime switch button 107 flashes blue, medical switch button 108 flashes amber and fire switch button 109 flashes red. These emergency switch buttons are selectable for transmitting different and preprogrammed fixed coded pulse signals for each type emergency to the other alert units in the watch circuit. Audible alarm 111 is associated with the receiver on each alert unit to sound when the receiver decodes an appropriate coded signal to inform neighbors at the other alert units of an existing emergency. Electrical plug 110 is for plugging into a wall electrical socket.

Figure 2:
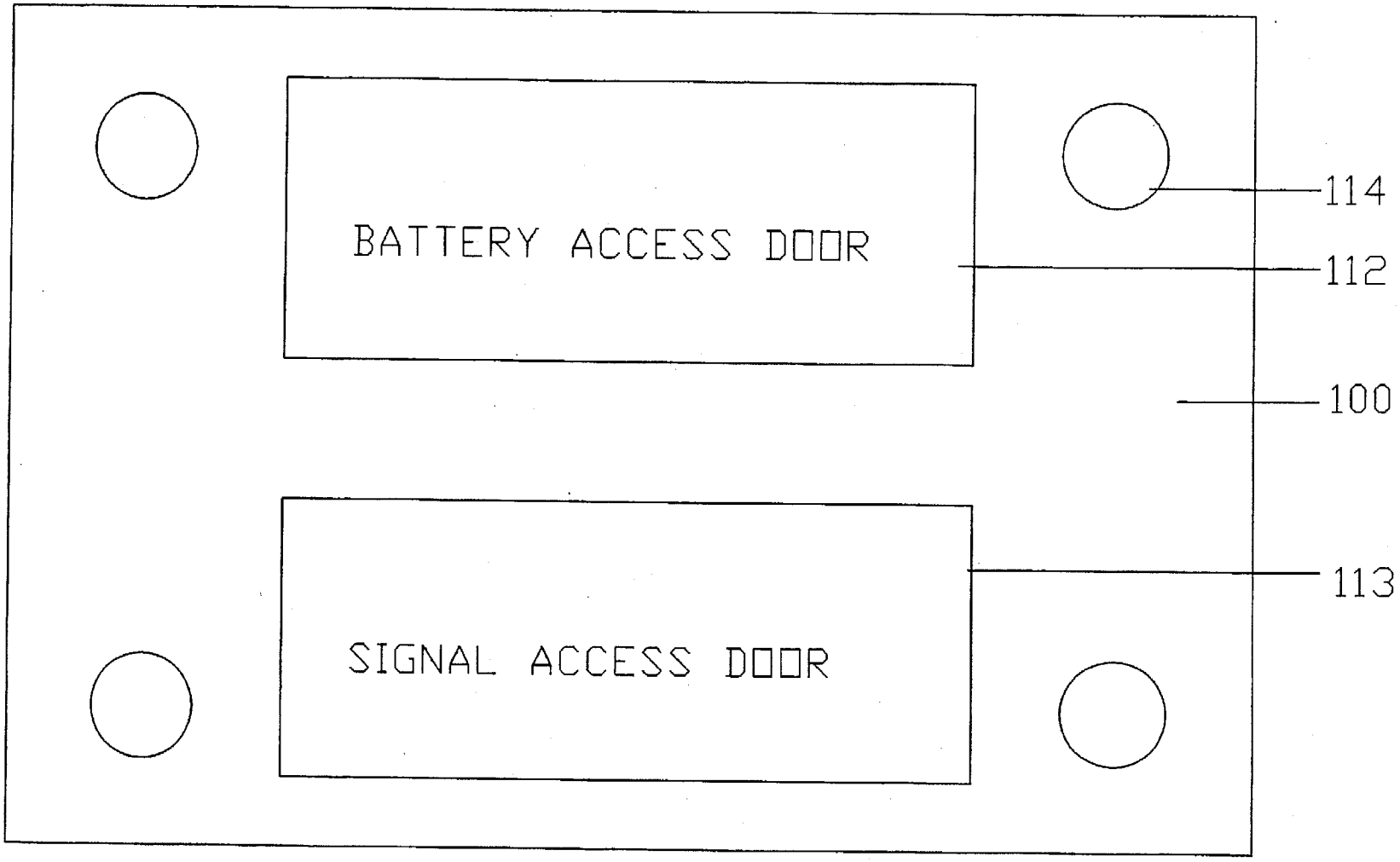
FIG. 2 is a bottom view of the alert unit of FIG. 1.
Figure 3:
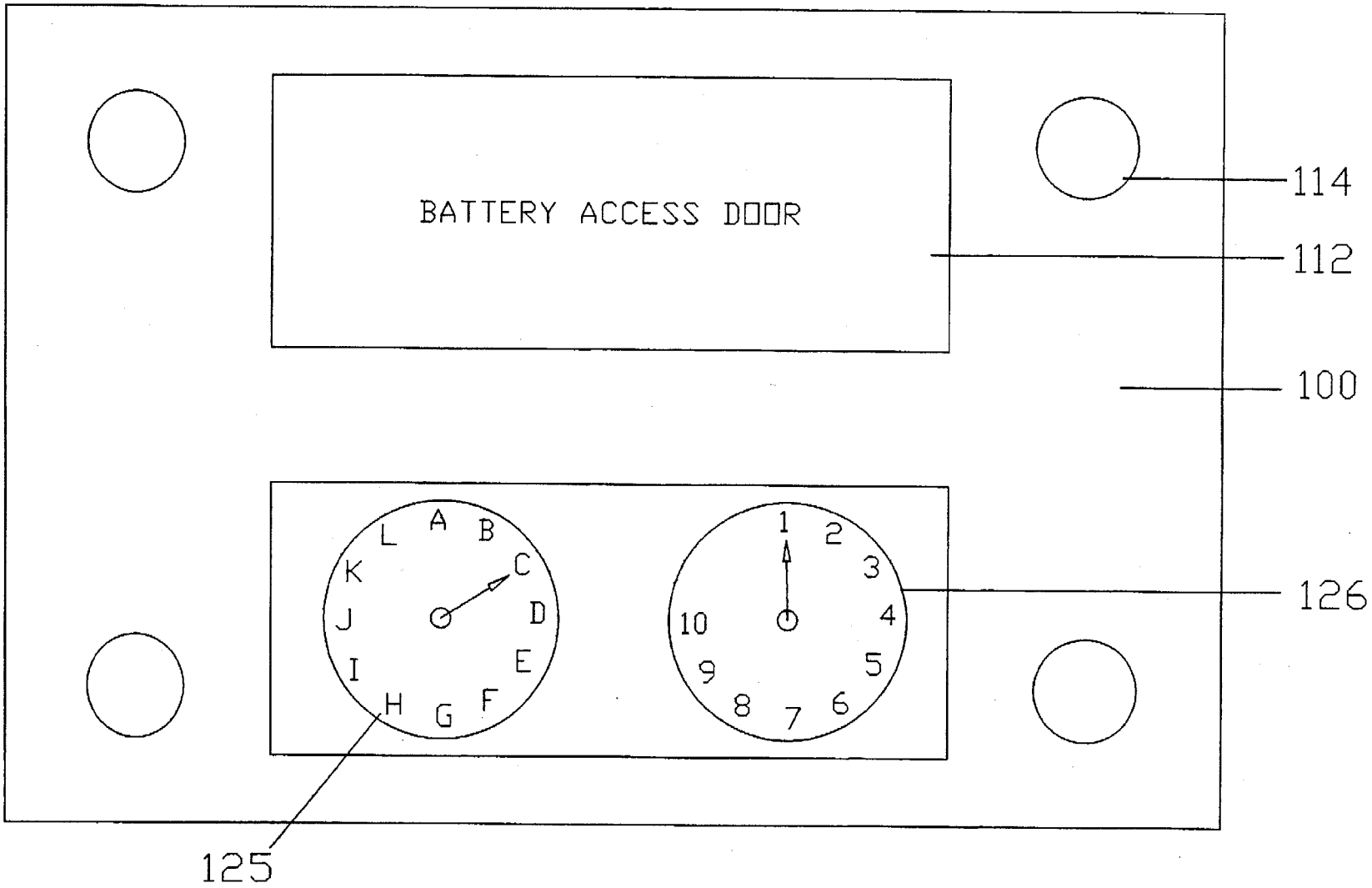
FIG. 3 is also a bottom view of the alert unit of FIG. 1 with the signal access door removed.

The bottom of alert unit 100 shown in FIGS. 2 and 3 has a battery access door 112 for replacing batteries (not shown) that are the backup source of power in the event of electrical power failure. It is also noted that while not shown, the alert unit 100 may also be provided with a compact battery charger that maintains the batteries charged to assure continuous ability of the alert unit to function even during electrical power failure. Four corner supports 114 are provided on the bottom of alert unit 100 for supporting same.

Also shown in FIG. 2 is signal access door 113 that covers a signal compartment.

The signal compartment in the bottom of alert unit 100 is shown in FIG. 3 as housing (1) a radio wave frequency control unit 125 for selecting from frequency settings A–L the desired frequency, such as setting C as shown herein, that is common to all alert units in the watch circuit, and (2) a signal coder pulse control 126 that has preprogrammed distinct and different coded pulse settings numbered 1–10, with the numbers corresponding to the alert unit number in the watch circuit, such as setting 1 for alert unit #1 shown herein.

Figure 5:
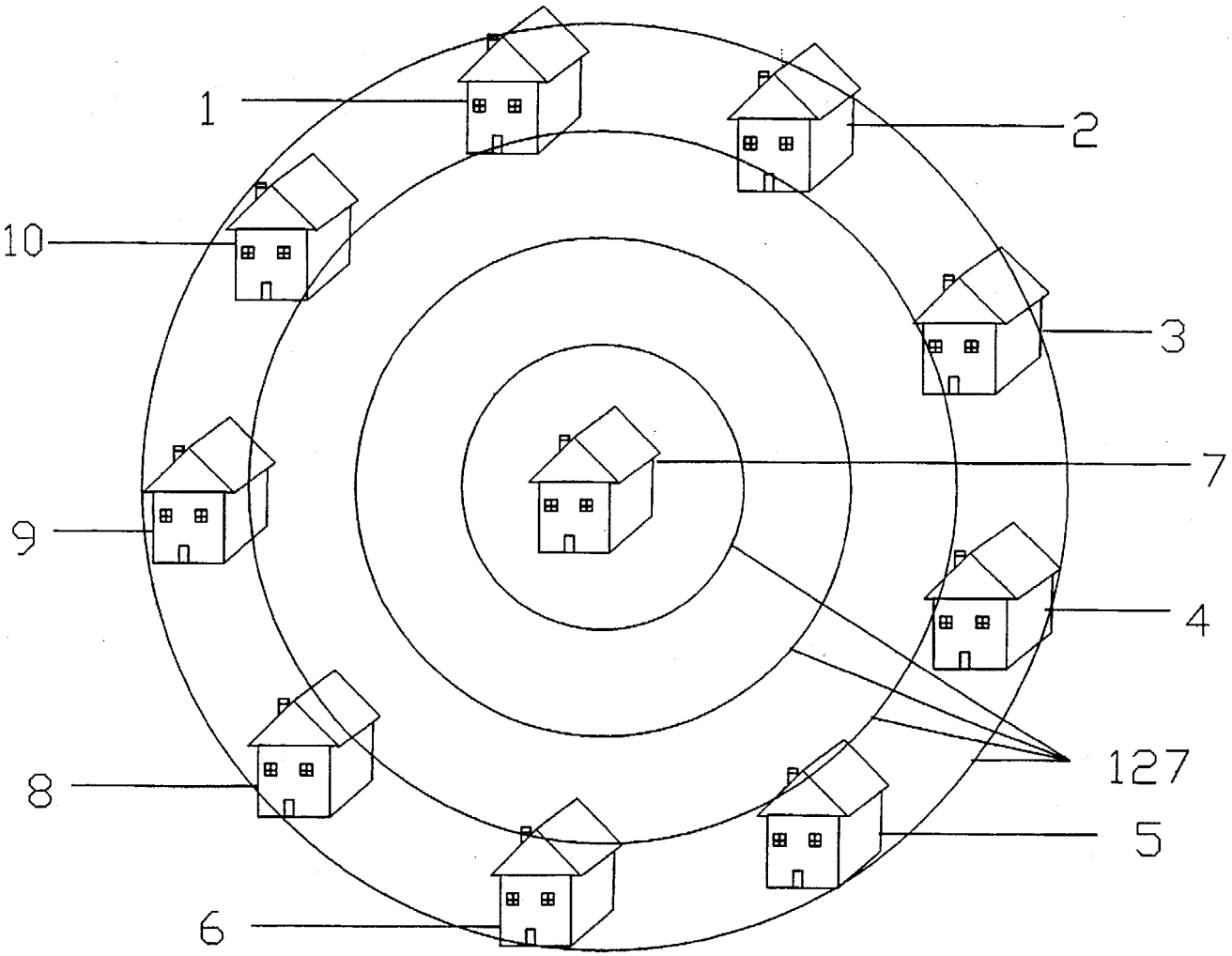
FIG. 5 is a view of an alert unit transmitting emergency signals to other units in a plurality of homes in a residential neighborhood watch alert system according to this invention.

As shown in FIG. 5, alert unit #7 is transmitting omnidirectional emergency and address visual indicator signals 127 to the other alert system units 1–6 and 8–10 in the watch circuit to notify them of an emergency and the address of the transmitting unit. It is noted that for the purpose of illustration transmitting unit #7 is shown in the center of a circle of other units 1–6 and 8–10 in the watch circuit, but any of the alert units in this arrangement could be transmitting the signals, and other alert unit arrangements could be used as long as the signals are capable of reaching the most remote alert unit in the watch circuit.

Figure 4C:
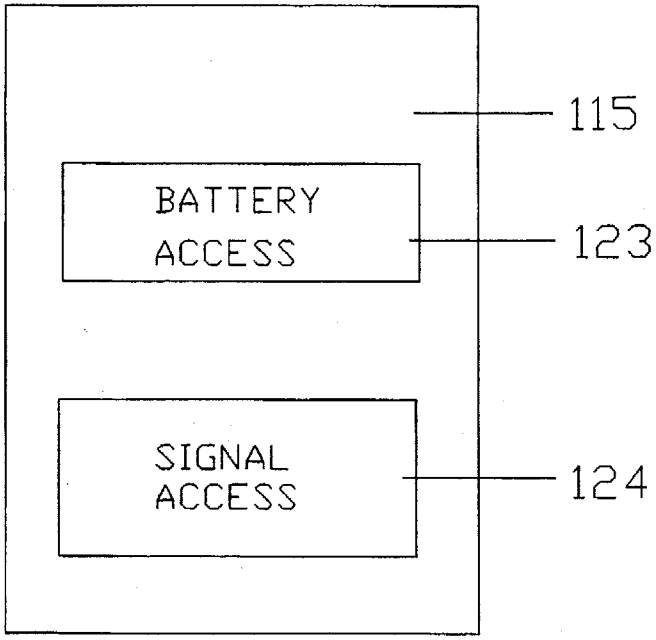
FIG. 4C is a back view of the remote control device of FIG. 4A and FIG. 4B with the belt clip omitted.
Figure 4B:
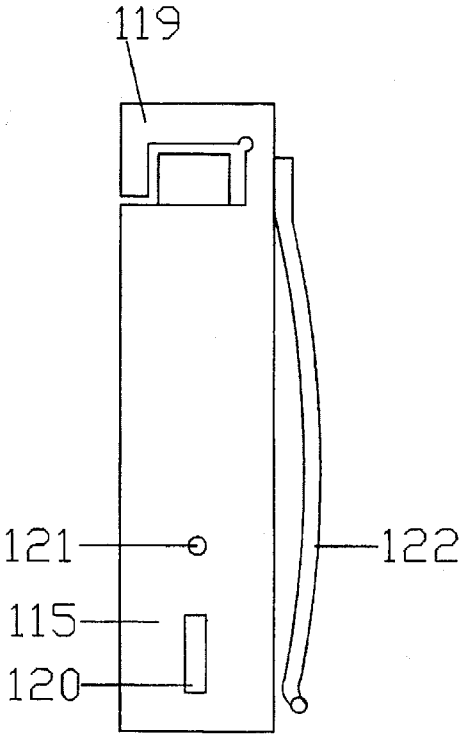
FIG. 4B is a side view of the remote control device of FIG. 4A with a belt clip attached to the back thereof.
Figure 4A:
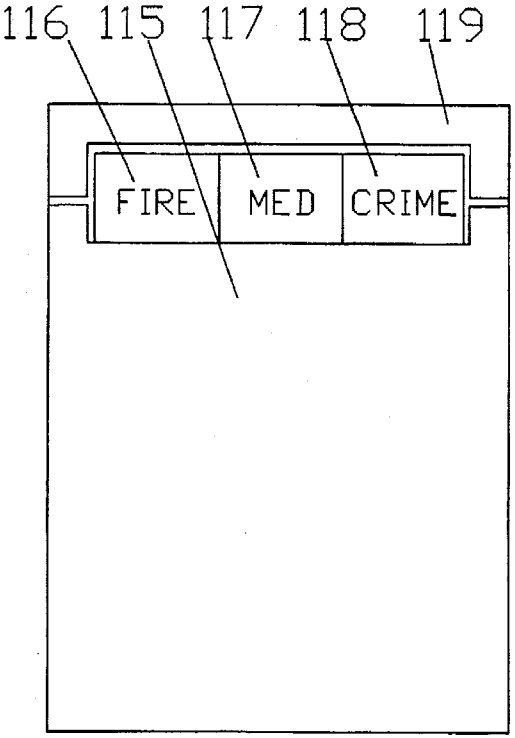
FIG. 4A is a front view of a portable remote control device for actuating a particular unit of a plurality of units in an alert system according to the present invention.

The remote control device 115 shown in FIGS. 4A, 4B and 4C is provided to permit anyone, and especially the vulnerable such as the handicapped, senior citizens and latchkey children at a given alert unit address freedom to move about within a limited distance from the alert unit but still have the capability to activate the given alert unit with the remote control 115. The remote control 115 is code signal matched on the same frequency and coded pulse setting as the given alert unit so as to be able to actuate same to transmit the coded signals for notifying the members of the watch circuit of an emergency and the location thereof.

As illustrated in FIGS. 4A and 4B, the remote control 115 has an open ended cover 119 that is pivotably connected to the back of the remote control 115 by a reduced cross-section resilient hinge portion. The cover 119 shields emergency type button switches 116, 117 and 118 to prevent inadvertent actuation thereof while readily permitting cover 119 to be pivoted from over the button switches 116, 117 and 118 to allow intentional actuation of a selected emergency type switch. The remote control 115 switch buttons 116, 117 and 118 represent three different types of emergencies, i.e. fire, medical and crime, respectively, which correspond to switch buttons 109, 108 and 107 on the alert units. The remote control 115, as shown in FIG. 4B, also has a test switch 120 and test light 121 for checking the charge of a battery that is housed in a compartment behind the battery access cover 123 shown in FIG. 4C. FIG. 4B also shows a clip 122 for clipping the remote control 115 to a person's belt or clothing for portability (clip 122 is omitted from FIG. 4C in order to more clearly illustrate the battery access and signal access covers 123 and 124). It is noted that the compartment behind the signal access cover 124 in FIG. 4C houses a frequency control and pulse control similar to transmitter frequency control 125 and signal coder pulse control 126 shown in FIG. 3 so that the remote control 115 can be programmed with the matched coded signals having the same frequency setting and same pulse setting as the alert unit with which it is to be used to remotely control same.

Figure 6:
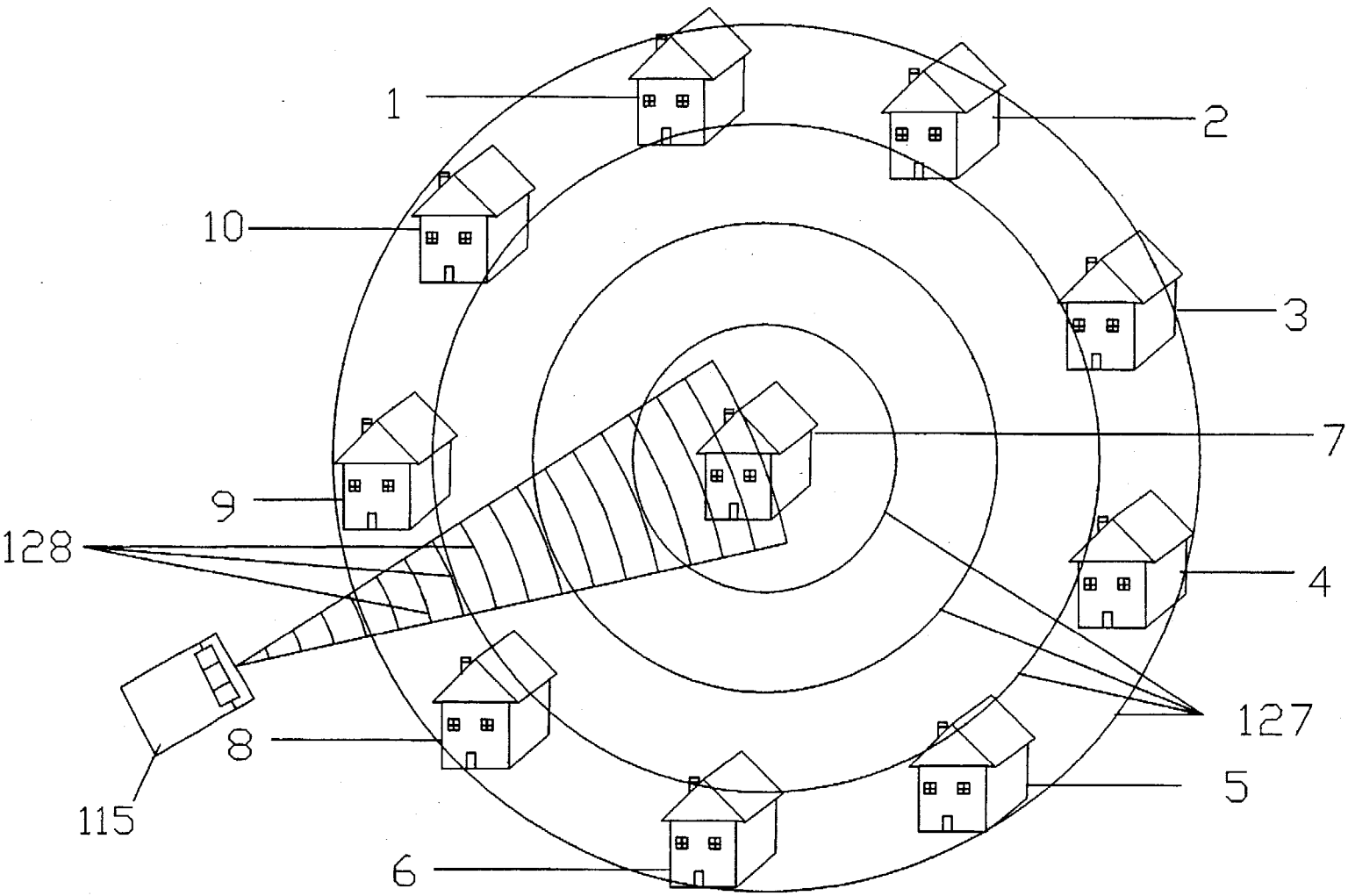
FIG. 6 is a view of a hand held portable remote control device actuating the transmitting alert unit in the residential neighborhood watch circuit shown in FIG. 5.

FIG. 6 is similar to FIG. 5 but additionally illustrates how the remote control 115 could be used from a distal location to activate the alert unit #7 with which it shares matched coded signals, i.e., same frequency signal and same pulse setting as alert unit #7, to cause the emergency type switch on alert unit #7 to be activated and transmit the emergency type and address visual indicator signals to the other units in the watch circuit.

Figure 7:
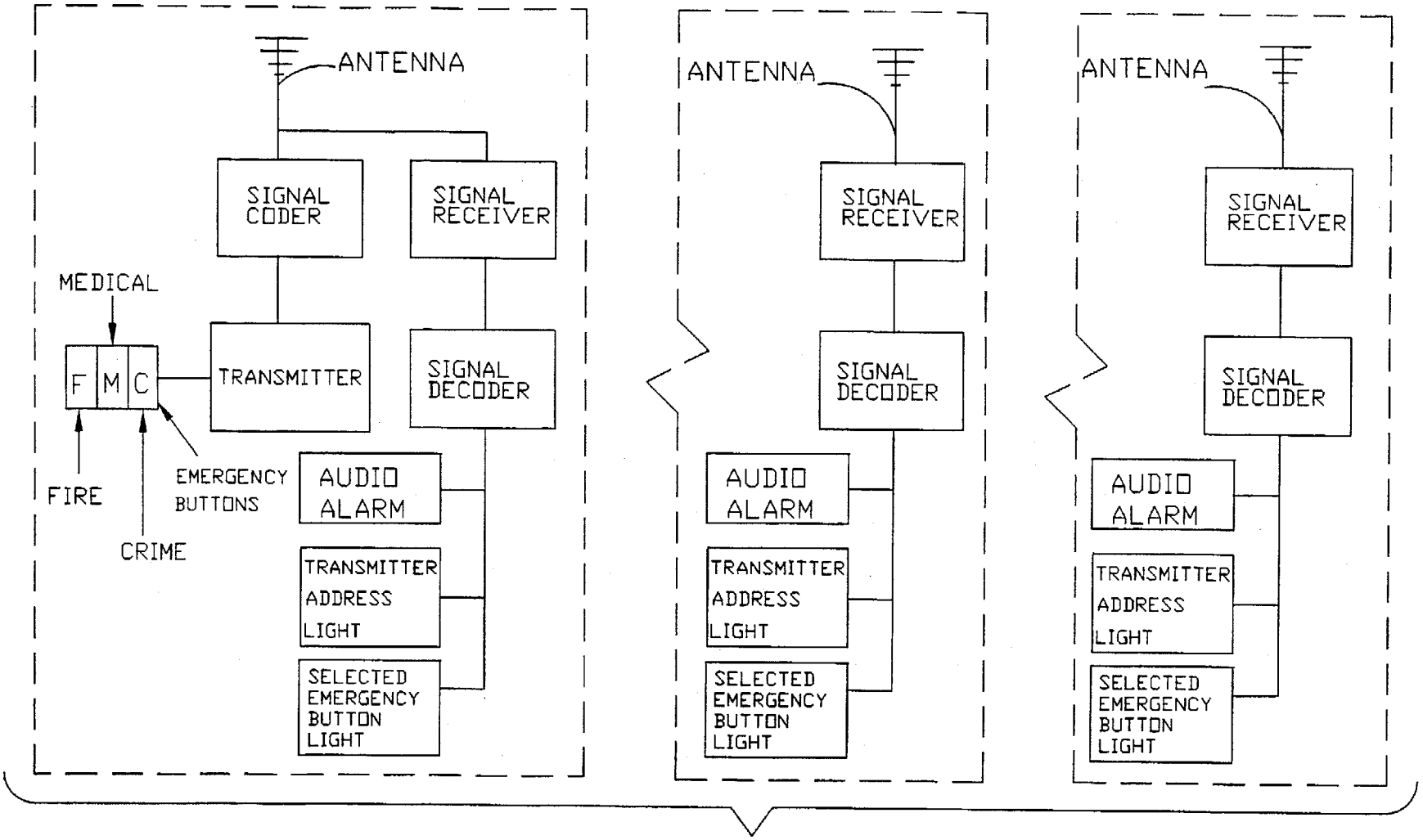
FIG. 7 is a diagrammatic view of a complete alert unit on the left hand side of the Figure and a partial view of the receiver portion of several alert units of a neighborhood watch alert system according to this invention.

A block diagram is shown in FIG. 7 to illustrate a complete radio wave signal alert unit with a transmitter section and a receiver section in the left hand side of the figure, and two partial alert units with receiver sections only in the middle and right hand sides of the figure.

Alert units 1–10 shown in FIGS. 5 and 6 have been preset (1) by using a frequency control 125 to set the radio wave frequency signal on units 1–10 at the same frequency setting C, and (2) to set the pulse signal control 126 of the signal coder on the number of the unit in the watch circuit, i.e., setting 1 for alert unit #1 in FIG. 3 and setting 7 for transmitting alert unit #7 in FIGS. 5 and 6.

The block diagram of FIG. 7 illustrates that by pushing an emergency button such as M on alert unit #7 a fixed medical coded pulse signal is combined with the alert unit #7 coded pulse address signal developed by the signal coder, and the transmitter sends the combined signals out to the antennas and receiver sections of all alert units in the watch circuit, units 1–10 as shown herein, where the combined signal is separated by the signal decoder to (1) sound the audible alarm to call attention to an emergency in the watch circuit, (2) light the transmitting unit address light to locate the emergency, and (3) light the light of the particular type emergency button to identify the emergency need.

The claims to this invention are as follows:

I claim:

1. An alert unit for use in a watch circuit system comprising:

a manually actuated means for transmitting user selectable coded signals including an address visual indicator means coded signal to other alert units in the watch circuit;

an audible alarm;

a plurality of separate address indicia means with a plurality of associated separate coded signal responsive visual indicator means to identify and locate each transmitting alert unit in the watch circuit; and means for receiving transmitted coded signals including an address visual indicator means coded signal from another like alert unit in the watch circuit to cause sounding of said audible alarm and actuate said address visual indicator means to identify and locate said another transmitting alert unit.

2. An alert unit according to claim 1, wherein said address visual indicator means are light bulbs.

3. An alert unit according to claim 1, wherein the coded signals are radio wave frequency signals.

4. An alert unit according to claim 1, wherein said address indicia means are address labels.

5. An alert unit for use in a watch circuit system comprising:

a manually actuated means for transmitting coded signals including an address visual indicator means coded signal to other alert units in the watch circuit;

an audible alarm;

a plurality of separate address indicia means with a plurality of associated separate coded signal responsive visual indicator means to identify and locate each transmitting alert unit in the watch circuit; and means for receiving transmitted coded signals including an address visual indicator means coded signal from another like alert unit in the watch circuit to cause sounding of said audible alarm and actuate said address visual indicator means to identify and locate said another transmitting alert unit;

wherein said means for transmitting coded signals has a plurality of lightable emergency switches representing different types of emergencies, each of said emergency switches being selectable for transmitting a different coded emergency type signal along with a different and distinct coded address signal to activate on the alert units said audible alarm, the type of emergency switch light and the address visual indicator means to identify and locate the transmitting alert unit.

6. An alert unit according to claim 5, wherein said plurality of lightable emergency switches include a fire switch, a medical switch and a crime switch with different colored flashing lights.

7. A watch circuit system comprising:

a plurality of alert units equal in number to a plurality of addresses of the members in the watch circuit;

each alert unit having a manually actuated means for transmitting user selectable coded signals including an address visual indicator means coded signal to other alert units in said watch circuit;

each said alert unit including an audible alarm;

each said alert unit further having a plurality of separate address indicia means with a plurality of associated separate coded signal responsive visual indicator means to identify and locate each transmitting alert unit in said watch circuit; and each said alert unit also having means for receiving transmitted coded signals including an address visual indicator means coded signal from another like alert unit in said watch circuit to sound said audible alarm and actuate said address visual indicator means to identify and locate said another transmitting alert unit.

8. A watch circuit system according to claim 7, wherein said address visual indicator means are light bulbs.

9. A watch circuit system according to claim 7, wherein said coded signals are radio wave frequency signals.

10. A watch circuit system according to claim 7, wherein said address indicia means are address labels.

11. An alert unit for use in a watch circuit system comprising:

a manually actuated means for transmitting coded signals including an address visual indicator means coded signal to other alert units in the watch circuit;

an audible alarm;

a plurality of separate address indicia means with a plurality of associated separate coded signal responsive visual indicator means to identify and locate each transmitting alert unit in the watch circuit; and means for receiving transmitted coded signals including an address visual indicator means coded signal from another like alert unit in the watch circuit to cause sounding of said audible alarm and actuate said address visual indicator means to identify and locate said another transmitting alert unit;

wherein said coded signals are user selectable fixed frequency and user selectable varied pulse radio wave frequency signals.

12. A watch circuit system comprising:

a plurality of alert units equal in number to a plurality of addresses of the members in the watch circuit;

each alert unit having a manually actuated means for transmitting coded signals including an address visual indicator means coded signal to other alert units in said watch circuit;

each said alert unit including an audible alarm;

each said alert unit further having a plurality of separate address indicia means with a plurality of associated separate coded signal responsive visual indicator means to identify and locate each transmitting alert unit in said watch circuit; and each said alert unit also having means for receiving transmitted coded signals including an address visual indicator means coded signal from another like alert unit in said watch circuit to sound said audible alarm and actuate said address visual indicator means to identify and locate said another transmitting alert unit;

wherein said means for transmitting coded signals has a plurality of lightable emergency switches representing different types of emergencies, each of said emergency switches being selectable for transmitting a different coded emergency type signal along with a different and distinct coded address signal to activate on said alert units said audible alarm, the type of emergency switch light and said address visual indicator means to identify and locate the transmitting alert unit.

13. A watch circuit system according to claim 12, wherein said plurality of lightable emergency switches include a fire switch, a medical switch and a crime switch with different colored flashing lights.

14. An alert unit for use in a watch circuit system comprising:

a manually actuated means for transmitting coded signals including an address visual indicator means coded signal to other alert units in the watch circuit;

an audible alarm;

a plurality of separate address indicia means with a plurality of associated separate coded signal responsive visual indicator means to identify and locate each transmitting alert unit in the watch circuit; and means for receiving transmitted coded signals including an address visual indicator means coded signal from another like alert unit in the watch circuit to cause sounding of said audible alarm and actuate said address visual indicator means to identify and locate said another transmitting alert unit;

wherein a remote control device is provided for each alert unit that is code signal matched with its alert unit to enable a member of the watch circuit to have freedom of movement within a limited distance of the alert unit but still have the capability of actuating same.

15. A watch circuit system comprising:

a plurality of alert units equal in number to a plurality of addresses of the members in the watch circuit;

each alert unit having a manually actuated means for transmitting coded signals including an address visual indicator means coded signal to other alert units in said watch circuit;

each said alert unit including an audible alarm;

each said alert unit further having a plurality of separate address indicia means with a plurality of associated separate coded signal responsive visual indicator means to identify and locate each transmitting alert unit in said watch circuit; and each said alert unit also having means for receiving transmitted coded signals including an address visual indicator means coded signal from another like alert unit in said watch circuit to sound said audible alarm and actuate said address visual indicator means to identify and locate said another transmitting alert unit;

wherein said coded signals are user selectable fixed frequency and user selectable varied pulse radio wave frequency signals.

16. A watch circuit system comprising:

a plurality of alert units equal in number to a plurality of addresses of the members in the watch circuit;

each alert unit having a manually actuated means for transmitting coded signals including an address visual indicator means coded signal to other alert units in said watch circuit;

each said alert unit including an audible alarm;

each said alert unit further having a plurality of separate address indicia means with a plurality of associated separate coded signal responsive visual indicator means to identify and locate each transmitting alert unit in said watch circuit; and each said alert unit also having means for receiving transmitted coded signals including an address visual indicator means coded signal from another like alert unit in said watch circuit to sound said audible alarm and actuate said address visual indicator means to identify and locate said another transmitting alert unit;

wherein a remote control device is provided for each alert unit that is code signal matched with its alert unit to enable a member of a watch circuit to have freedom of movement within a limited distance of their alert unit but still have the capability of actuating same.

* * * * *